US006575816B2

(12) United States Patent
Hempel et al.

(10) Patent No.: US 6,575,816 B2
(45) Date of Patent: Jun. 10, 2003

(54) DUAL PURPOSE HANDOFF STATION FOR WORKPIECE POLISHING MACHINE

(75) Inventors: Gene Hempel, Gilbert, AZ (US); Mike L. Bowman, Chandler, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 212 days.

(21) Appl. No.: 09/764,245

(22) Filed: Jan. 17, 2001

(65) Prior Publication Data

US 2001/0005665 A1 Jun. 28, 2001

Related U.S. Application Data

(62) Division of application No. 09/264,066, filed on Mar. 8, 1999.

(51) Int. Cl.[7] ..... B24B 1/00

(52) U.S. Cl. ..... 451/41; 451/66; 451/57; 451/288; 451/388

(58) Field of Search ..... 451/41, 57, 66, 451/67, 388, 456, 400, 288; 438/692–693

(56) References Cited

U.S. PATENT DOCUMENTS

| | | | | |
|---|---|---|---|---|
| 4,141,180 A | | 2/1979 | Gill, Jr. et al. | |
| 5,246,525 A | | 9/1993 | Sato | |
| 5,335,453 A | * | 8/1994 | Baldy et al. | 451/168 |
| 5,643,053 A | | 7/1997 | Shendon | |
| 5,738,574 A | * | 4/1998 | Tolles et al. | 451/288 |
| 5,797,789 A | | 8/1998 | Tanaka et al. | |
| 5,804,507 A | * | 9/1998 | Perlov et al. | 438/692 |
| 5,830,045 A | | 11/1998 | Togawa et al. | |
| 5,876,271 A | | 3/1999 | Oliver | |
| 5,908,347 A | * | 6/1999 | Nakajima et al. | 451/5 |
| 5,908,530 A | * | 6/1999 | Hoshizaki et al. | 156/345.14 |
| 5,934,984 A | | 8/1999 | Togawa et al. | |
| 5,964,646 A | | 10/1999 | Kassir et al. | |
| 6,050,884 A | | 4/2000 | Togawa et al. | |
| 6,110,024 A | * | 8/2000 | Togawa | 451/285 |
| 6,227,950 B1 | * | 5/2001 | Hempel et al. | 451/66 |

FOREIGN PATENT DOCUMENTS

| | | |
|---|---|---|
| EP | 0 761 387 A1 | 3/1997 |
| EP | 0 774 323 A2 | 5/1997 |
| EP | 0 792 721 A1 | 9/1997 |
| EP | 0 842 738 A2 | 11/1997 |
| WO | WO 99/26763 | 6/1999 |

* cited by examiner

*Primary Examiner*—George Nguyen
(74) *Attorney, Agent, or Firm*—Snell & Wilmer, L.L.P.

(57) ABSTRACT

The present invention provides a dual purpose workpiece handoff station for intermediately staging a semiconductor wafer, or other workpiece, being transferred between processing stations in, for example, a Chemical-Mechanical Planarization (CMP) machine. The handoff station includes a workpiece processing surface; such as a polishing pad or buffing pad, defining a plurality of apertures for applying fluids, including water, chemicals, slurry, or vacuum, to the surface of a workpiece. In operation, a workpiece carrier moves a polished wafer from a primary polishing surface to the handoff station, and polishes, buffs, or cleans the wafer in the handoff station by rotating the wafer and oscillating the wafer across the handoff station polishing surface while pressing the wafer thereon.

5 Claims, 4 Drawing Sheets

DUAL PURPOSE HANDOFF STATION FOR WORKPIECE POLISHING MACHINE

STATEMENT OF RELATED APPLICATION

This application is a divisional application of U.S. Ser. No. 09/264,066 filed Mar. 8, 1999.

FIELD OF THE INVENTION

The present invention relates to chemical mechanical polishing of workpieces. In particular, the present invention relates to a workpiece handoff station for staging workpieces between processing stations, the handoff station including a workpiece processing surface.

BACKGROUND ART AND TECHNICAL PROBLEMS

Recent rapid progress in semiconductor device integration demands smaller and smaller wiring patterns or interconnections, and narrower spaces between interconnections which connect active areas. One of the processes available for forming such interconnections is photolithography. Though the photolithographic process can form interconnections that are at most 0.5 microns wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is by Chemical Mechanical Planarization (CMP), which is a process whereby semiconductor wafers are polished with a polishing apparatus.

Conventionally, a CMP polishing apparatus has a turntable and a wafer carrier which rotate at respective individual speeds. A polishing pad is attached to the upper surface of the turntable. A semiconductor wafer seated in the carrier is lowered into engagement with the polishing pad, and clamped between the carrier and the turntable, typically through the exertion of downward force by the carrier. An abrasive grain containing liquid (known as slurry) is deposited onto the polishing pad and retained on the polishing pad. During operation, the carrier exerts a certain pressure on the turntable, and the surface of the semiconductor wafer held against the polishing pad is therefore polished by a combination of chemical polishing and mechanical polishing to a flat mirror finish while the carrier and the turntable are rotated.

The semiconductor wafer that has been polished carries abrasive liquid and ground-off particles attached thereto. Therefore, after polishing, the semiconductor wafer is cleaned and dried in one or more cycles and then housed in a clean storage cassette. If the wafer is not cleaned immediately, the slurry and foreign particles applied to the lower surface of the wafer tend to solidify, becoming very difficult to remove. Also, the known standard cleaning processes, employing, for example, roller brush box type cleaners, are largely ineffective at removing submicron scratches left on the wafer surface by the polishing process.

Thus, additional processing is typically done prior to the wafer cleaning step. For example, a second polish turntable with a second carrier may be employed, using a relatively soft buffing pad in combination with a cleaning chemical, or ultra pure water alone. The buffing process can be effective at removing the residual slurry and buffing out the surface scratches left from the polishing process before cleaning the wafer. However, the effectiveness of the buffing process is also affected by the length of time that slurry sits on the wafer between the polish and buffing process. Unfortunately, adding the buffing process necessitates additional wafer handling and transferring capability, increased tool foot print, and often reduced wafer throughput as a result.

Alternatively, the slurry and surface scratches may be removed through use of a Hydrofluoric (HF) acid etching process. In such a process, the wafer may be dipped in a bath of the HF acid solution and/or cleaned with an HF solution in a somewhat conventional brush box. However, HF acid poses serious health risks. Compliance with industry safety standards governing the use of HF acid adds substantially to the cost of the equipment and the facility which houses the equipment when employing these techniques.

SUMMARY OF THE INVENTION

It is an object of the present invention to provide a method and apparatus for cleaning post polish slurry residue from the surface of a wafer without allowing time for the residue to significantly solidify.

It is another object of the present invention to provide a method and apparatus for buffing a wafer to remove post polish defects that minimizes the time between polishing and buffing and does not increase tool footprint.

It is still another object of the present invention to provide an alternative solution to HF acid etch for pre-cleaning removal of wafer surface particles and defects without employing a conventional buffing table.

The present invention achieves these objects by providing a dual purpose workpiece handoff station for intermediately staging a semiconductor wafer (or other workpiece) being transferred between processing stations in a CMP machine. The handoff station includes a workpiece processing surface such as a polishing pad or buffing pad which includes a plurality of apertures for applying fluids to the surface of a workpiece. A fluid delivery system is provided for selectively delivering water, chemicals, or slurry, for cleaning and polishing. In addition, the delivery system may provide vacuum for holding a wafer, or nitrogen for wafer blowoff.

In operation, a workpiece carrier moves a polished workpiece from a primary polishing surface to the handoff station, and polishes, buffs, or cleans the workpiece in the handoff station by rotating the workpiece and oscillating the workpiece across the handoff station polishing surface while pressing the workpiece thereon. Cleaning or buffing chemicals may be simultaneously applied to the workpiece. A robot, preferably track mounted, retrieves the wafer from the handoff station and transfers it to a subsequent station, for example to a second primary polish station, or to a cleaning station.

These and other objects, features and advantages of the present invention are specifically set forth in, or will become apparent from, the following detailed description of a preferred embodiment of the invention when read in conjunction with the accompanying drawings.

DETAILED DESCRIPTION OF THE PREFERRED EMBODIMENT

Figure 1:
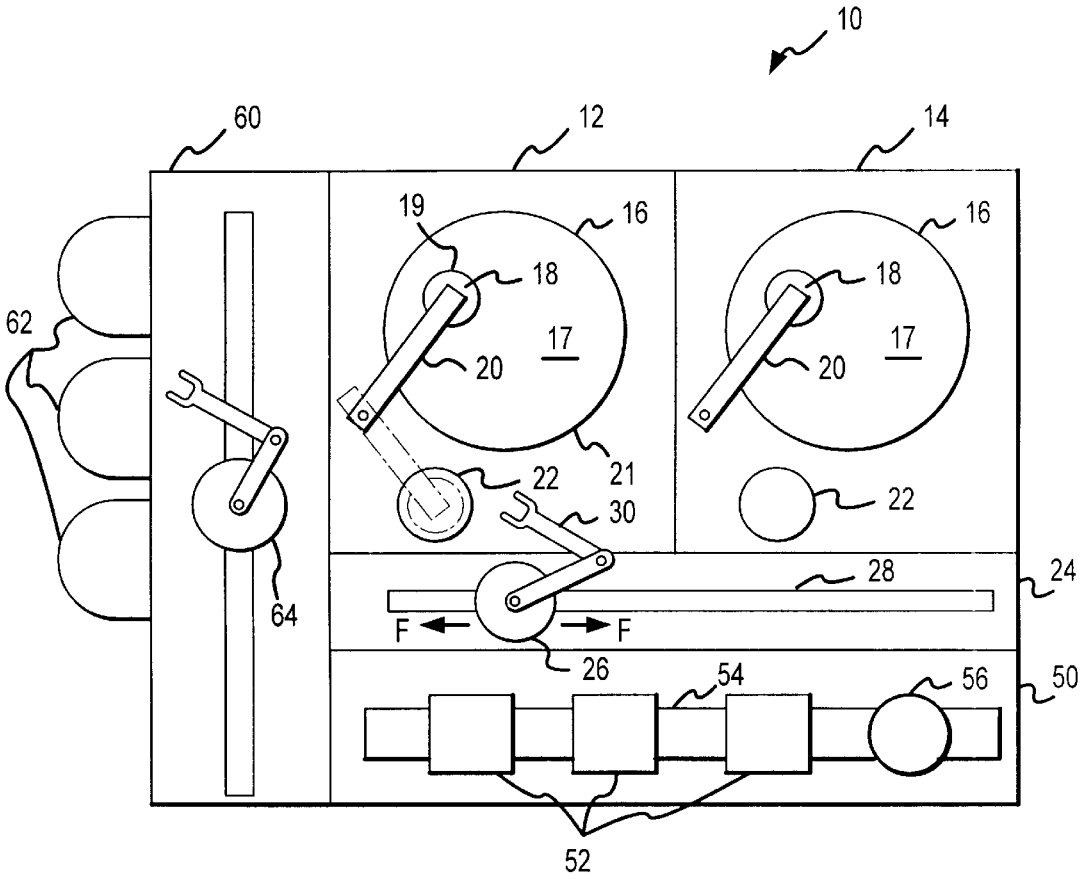
FIG. 1 depicts a plan view of a polishing apparatus including the dual purpose handoff station of the present invention.

A polishing apparatus according to the present invention suitable for polishing silicon wafers, or other workpieces, will be described below with reference to FIGS. 1 through 4. First referring to FIG. 1, a polishing apparatus 10 comprises two generally rectangular polishing modules 12, and 14 positioned adjacent one another. Each of the polishing modules 12, 14 include a polishing surface 16, a wafer carrier 18 movably supported by an arm 20, and a wafer handoff station 22. A polishing surface 16 generally comprises a polishing pad 17 positioned atop a support platform 21. The pad 17 and platform 21 may take any of a variety of suitable known forms, for example, the pad and support platform may be circular as shown in FIG. 1, where the pad 17 is fixed for example by adhesive, to the upper surface of a rotatable or non-rotatable platform 21. In another embodiment, pad 17 may comprise a movable continuous belt which slides across the top of a generally rectangular shaped support platform. Any of a variety of types of polish pads 17 suitable for use with or without slurry may also be utilized in conjunction with platform 21. For example, polish pad 17 may comprise a two-layer IC-1000/Suba IV stack pad for CMP polishing available from Rodell Inc., a softer buffing type pad, or a slurry-less polishing pad containing fixed abrasive particles.

The arm 20 is suitably configured to provide the required structural support and movement capability for polishing a wafer on the polishing surface 16, and to move carrier 18 back and forth from the polishing surface 16 to the handoff station 22. Although depicted as a pivoting arm, any of a variety of suitable configurations providing the required motion and support, such as for example an overhead gantry and track arrangement (not shown) providing x-y motion capability, and the like, may be substituted for arm 20. The carrier 18 includes a lower wafer holding surface 19 (see FIG. 3), and is rotatable about a central axis for rotating a wafer 23 during polishing. Polishing modules 12 and 14 may further include a second polish arm 20 (not shown) positioned on the opposite side of polishing surface 16, also with a corresponding carrier 18 and a second handoff station 22 (also not shown).

The polish modules 12 and 14 may be utilized to perform similar or different types of processes, by for example, varying the type of polishing pad 17 provided, or varying the type of polishing slurry or other chemical applied thereon. A conventional utilization of polisher 10 involves a primary polish operation at polish module 12 using a CMP primary polish pad 17 with an abrasive polishing slurry, followed by a buffing process at module 14 using a softer pad 17 and deionized water, and finally a cleaning process, preferably including a Hydrofluoric (HF) acid cleaning step. As will be described in greater detail below, the present invention eliminates the second table buff process and HF acid cleaning step, thereby improving utilization of the polisher, tool safety, and wafer throughput.

The polishing apparatus 10 further includes a conveying unit 24 disposed alongside polishing modules 12 and 14. Conveying unit 24 includes a wafer handling robot 26 slidably mounted atop a track 28 so as to be movable in the directions indicated by arrows F. Track 28 extends substantially the length of polish modules 12 and 14, thereby providing robot 26 with access to load cups 22 of both polish modules 12, 14. Robot 26 includes an end effector 30 suitably configured to grip a wafer, and extendible in reach a sufficient amount to reach load cups 22 and retrieve or deposit a wafer thereon. End effector 30 may be any of a number of different commercially available types, such as the vacuum gripping type, or edge gripping type. An example of a suitable robot 26 and vacuum gripping type end effector 30 is disclosed in U.S. patent application Ser. No. 08/926,700 assigned to the assignee of this patent application, the relevant parts of which are hereby incorporated by reference.

The polishing apparatus 10 also includes a cleaning section 50 disposed alongside the conveyer module 24 opposite polish modules 12 and 14. The cleaning section 50 includes a plurality of cleaning modules 52 that may be conventional cleaning devices such as brush scrubbers, spin dryers, and the like, or less conventional devices such as an HF acid etch station. The cleaning modules 52 are interconnected by suitable wafer transport devices such as a water track 54 for providing serial transport of wafers through cleaning modules 52. Access into cleaning section 50 is provided for robot 26 to deposit a processed wafer onto a wafer-receiving portion 56 of water track 54.

Figure 2:
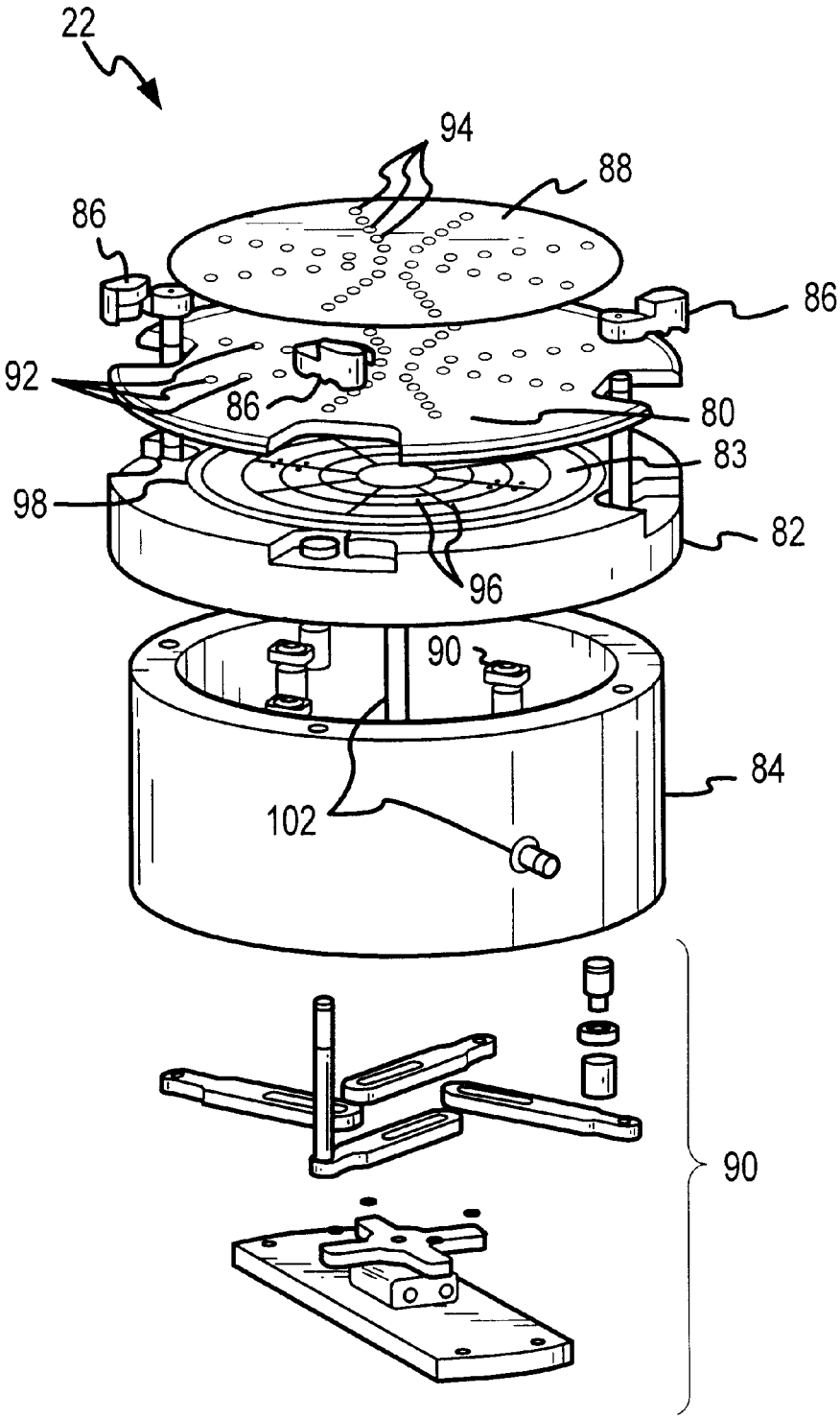
FIG. 2 depicts an exploded perspective view the dual-purpose handoff station of the present invention.
Figure 3:
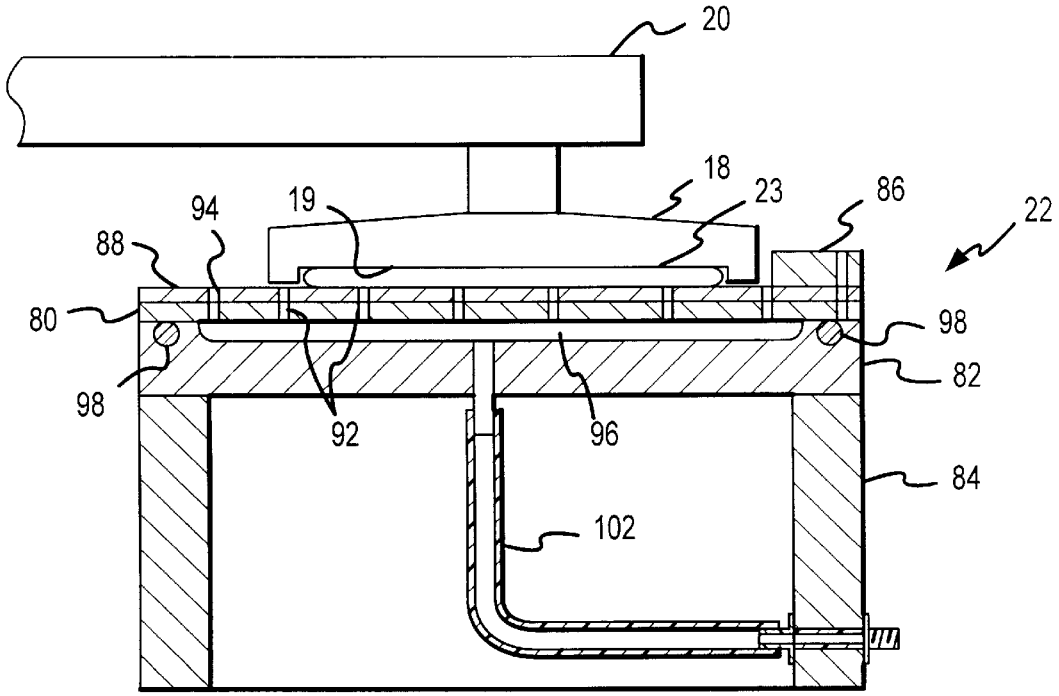
FIG. 3 depicts a cross-section view of the dual-purpose handoff station of FIG. 2.

A front end module 60 positioned at the end of polisher 10 adjacent polish module 12 and cleaning section 50 provides retrieval and storage of dry wafers. The polisher 10 provides for dry-in/dry-out wafer processing, whereby a group of dry unprocessed wafers initially contained in a wafer storage pod 62 are polished, buffed, cleaned, and then returned to the same storage pod 62. The front end module preferably includes at least three storage pods 62, and a dry wafer handling robot 64 for transferring wafers to and from pods 62 and to and from the processing modules of the polisher 10. A preferred well-known and commercially available type of storage pod 62 is the Front Opening Unload Pod (FOUP) type, which provides an enclosed mini-environment for the wafers. The FOUP type pod may be readily attached or detached from the front-end module 60 while providing an airtight seal thereto and maintaining the integrity of the wafer mini-environment. Turning now to FIGS. 2 and 3 a workpiece handoff station 22 in accordance with the present invention will be described. The workpiece handoff station 22 generally includes a workpiece support platform 80 which sits atop a manifolding plate 82 and body portion 84, and a polishing pad 88 affixed to the top of platform 80. The polishing pad 88 may be formed of any suitable material, from soft cloth to a relatively stiff plastic, as required for a particular cleaning, buffing, or polish operation to be performed. The platform 80 and pad 88 include a plurality of co-aligned apertures 92 and 94 for application of pressurized fluids, or vacuum therethrough to an underside of a wafer 21. The apertures 92, 94 are connected via the manifolding plate 82 to an arrangement of conduits and valves which are in turn connected to separately accessible sources of pressurized fluids, chemicals, and vacuum. The handoff station also includes three workpiece centering fingers 86 positioned around the perimeter of platform 80, and associated linkages 90.

Figure 4:
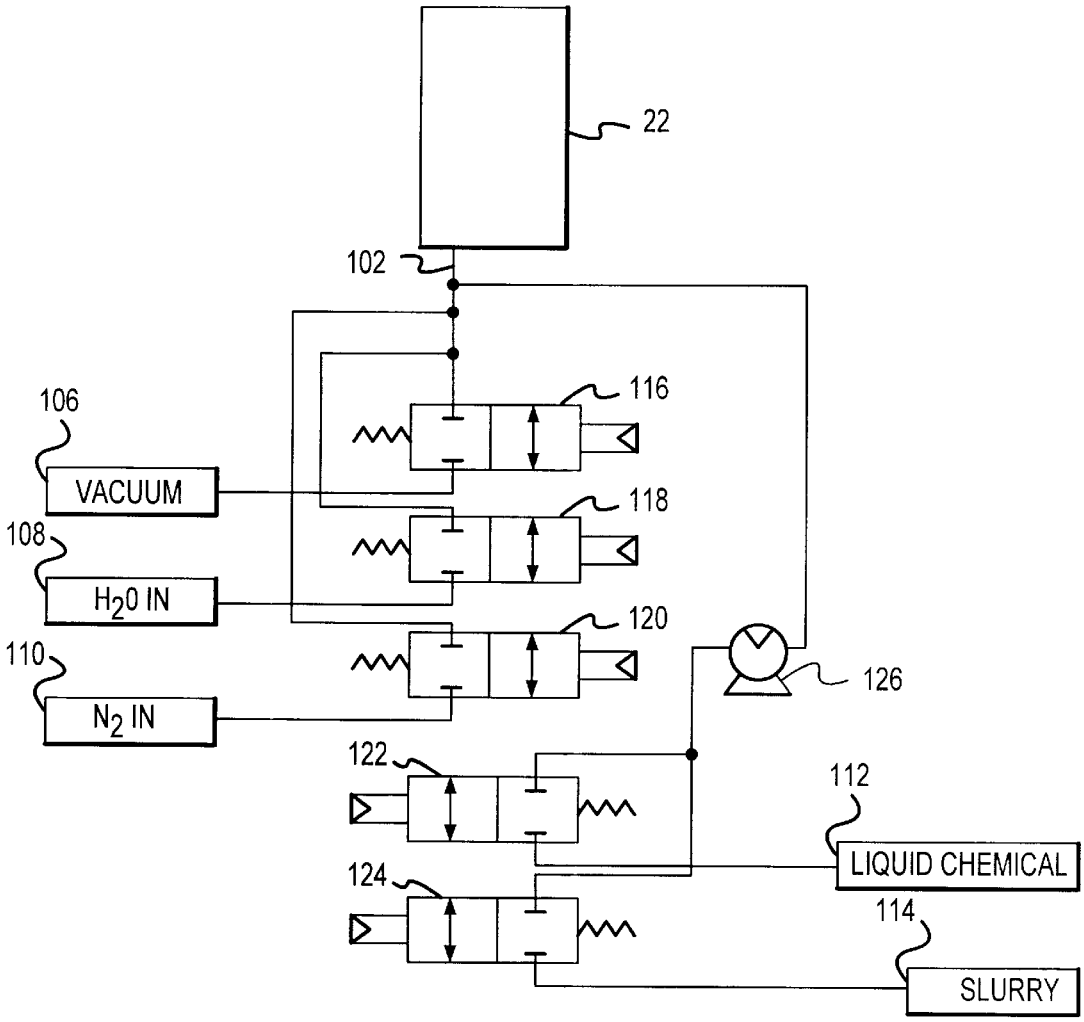
FIG. 4 depicts a schematic diagram of the fluid delivery system for the handoff station of the present invention.

Referring now to the schematic diagram of FIG. 4, a preferred piping and valving arrangement is depicted. As indicated, fluid access to load cup 22 is provided by a single main fluid supply conduit 102. Main fluid conduit 102 is connectable to a variety of fluid or gas sources to facilitate performance of various operations or processes on a wafer. In particular, main conduit 102 is coupled through valves 116, 118, 120, 122, 124 respectively to a vacuum source 106, an ultra-pure water source 108, a gaseous nitrogen source 110, a liquid chemical source 112, and an abrasive polishing slurry source 114. Preferably, an inline pump 126 is provided for pumping either liquid chemical from source 112 or polishing slurry from source 114, to load cup 22.

The valves 116–124 are independently operable to allow for individually connecting the main conduit 102 to the sources 106–14. Thus for example, simultaneously closing valves 118–124 while opening valve 116, connects load cup 22 through main conduit 102 to the vacuum source 106 only. A different source may then be accessed by closing valve 116 and opening a different selected valve, and so on.

Returning now to FIGS. 2 and 3, the load cup main fluid supply conduit 102 is connected from the underside of manifolding plate 82 to an array of interconnected open channels 96 formed in the upper surface 83 of plate 82. The channels 96 are covered by the undersurface of the platform 80 as assembled, thereby forming enclosed fluid passages. Mechanical pilots (not shown) are provided to position platform 80 angularly with respect to manifolding plate 82 such that the channels 96 align with the apertures 92 in platform 80. An O-ring type gasket 98 is provided between manifolding plate 82 and platform 80 to prevent leakage of fluids therebetween. Thus, pressurized fluid introduced through conduit 102 is distributed evenly through channels 96 and forced upward and out through apertures 92 and 94 for application to a surface of a wafer. Similarly, vacuum may be applied through apertures 92, 94, and channels 96 for drawing a wafer 21 down against platform 80.

Accordingly, a dual purpose workpiece handoff station is provided that serves both as a conventional wafer staging station, and as a wafer buffing, polishing or cleaning station. As a workpiece staging station, load cup 22 may be utilized, for example, to stage a wafer being transferred from the front end module 60 to the polishing surface 16 of polish module 12. In such a procedure, a wafer is transferred by robot 64 from module 60 to load cup 22 and deposited thereon. The centering fingers 86 are then actuated simultaneously with application of vacuum, to both center the wafer and fix the wafer in load cup 22. Next, arm 20 and carrier 18 are positioned directly over the load cup 22 and brought into contact with the upper surface of the wafer. The carrier 18 is caused to grip the wafer while, simultaneously, the load cup vacuum is stopped. The wafer is then transported by carrier 18 and arm 20 to polishing surface 16 for processing.

Load cup 22 may also serve as a staging station following wafer processing on polishing surface 16. As an example of such a procedure, after being polished on polishing surface 16, a wafer is transported by support arm 20 and carrier 18 to the load cup 22 and deposited thereon. Again, the centering fingers 86 are actuated simultaneously with application of vacuum to center and fix the wafer in load cup 22. Next, end effector 30 of robot 26 is brought into gripping contact with the wafer while simultaneously stopping the application of the load cup vacuum. The wafer is then removed from load cup 22, and transported by robot 26 to a desired subsequent station, such as receiving station 56 of cleaner module 50, or load cup 22 of polishing module 14. Load cup 22 may also be utilized as a cleaning or buff station to further process a wafer, intermediate to the above-described conventional handoff procedures. In a first such example, a wafer having been processed with a primary polishing procedure on a polishing surface 16 is transported by support arm 20 and carrier 18 to load cup 22. The carrier 18 is then lowered to bring the wafer into pressing engagement with the polishing pad 88. Carrier 18 and the wafer attached thereto are simultaneously rotated about a central axis of carrier 18, while the carrier is caused to oscillate laterally back and forth across polishing pad 88. With respect to a pivoted polishing arm configuration such as shown in FIG. 1, the lateral oscillatory motion is obtainable by swinging arm 20 back and forth, whereby carrier 18 traces an arcuate path across polishing pad 17.

At the same time the wafer is being rotated and translated back and forth, fluids may be applied to the undersurface of the wafer through the apertures 94 and 92. For example, if a cleaning operation or light buff operation is being performed, ultra pure water, or a very dilute liquid chemical solution may be conveniently applied to the wafer. Preferably a softer cleaning or buffing type pad 88 is used in such a process. Alternatively, an abrasive slurry may be applied to the wafer, for example to perform a more aggressive post polish buff operation, or even a second-table type polish operation, preferably followed by application of ultra pure water to rinse slurry residue from the wafer. For such polishing type operations, a stiffer polish pad material is preferable, such as an IC-1000 series pad made by Rodel Industries.

Thus, the load cup of the present invention may be used to perform a buffing, polishing, or cleaning operation typically performed by other polish or buffing tables, or cleaning devices in prior art polishing tools. Accordingly, an advantage of the present invention is that one or more polishing or cleaning devices may be eliminated from a polish tool, thereby reducing tool foot print, weight, and cost. This advantage is of particular significance with regard to the advent of copper interconnect wires in micro-electronic device structures. Two and three table polishing processes have shown promising results in polishing copper layers. Still, standards for maximum allowable overall tool foot print demanded by device manufacturers have not relaxed as a result. Thus, the dual purpose load cup of the present invention provides the capability to perform an additional device polishing step without increasing tool footprint.

Because of the close proximity of the load cup 22 to the polish surface 17, a wafer may be transported to the load cup 22 relatively quickly after polishing, as compared to prior art devices. Thus, the time between the polish operation on the main polish table 16 and the secondary operation performed in the load cup 22 is also reduced as compared to prior devices. For example, in a typical prior art polishing tool, the wafer is transported by the carrier to a staging location after the initial polishing process. The staging location may be a single fixed cup or a number of cups on an indexing table of the type typically used in conjunction with multiple head polishers. In the case of an indexing table, the wafer stays in its cup until the index table has indexed completely around and all the cups contain a polished wafer. Next, the polished wafer, or wafers, are retrieved from the staging station and carried to a second staging station adjacent a second polishing or buffing table. Finally, a carrier at the second polishing table picks up the wafer from the second staging station and moves it to the second polishing surface for further work.

The dual purpose load cup of the present invention greatly reduces the time between the first polishing process and a second operation performed on the wafer by eliminating the above described intermediate wafer handling steps. Thus, a wafer is transported directly from a polishing operation to a subsequent polish, clean, or buff operation by a single motion of carrier arm 20. An immediately apparent advantage realized by such a direct wafer transfer is the associated reduction of overall process time, and the corresponding increase in wafer throughput. Also as a direct result, the amount of time that polishing slurry residue is left sitting on the wafer surface is minimized. It is desirable to remove slurry residue as quickly as practical from a polished wafer because the longer it remains, the more it tends to set-up and the harder it is to remove. Thus in accordance with the present invention, the polishing slurry residue from a first polishing process may be advantageously removed from the surface of the wafer by a clean or buff process in the dual purpose load cup before it can begin to significantly set-up and adhere to the wafer.

It is also desirable to control or reduce the amount of time the device structure formed on the wafer is exposed to reactive chemicals in the slurry residue. In particular, copper interconnect wires are highly susceptible to corrosion from extended exposure to slurry residue. Accordingly, another advantage of the present invention is that the corrosive effects of slurry residue on copper wires of a polished device structure may be arrested by a subsequent cleaning of buff process in a more timely manner than possible with prior art polishing tools. It will be appreciated by one skilled in the art that a similar situation exists following a buff process in which certain reactive chemicals are utilized which may cause damage to the device structure if left sitting too long. In such a case, the present invention allows for quickly neutralizing the buffing chemicals with a subsequent cleaning operation before any significant damage to the device occurs.

It is further desirable to initiate a post polish buff process as quickly as possible to maximize the effectiveness of the buff process in removing defects left by the prior polishing process. Buffing processes in prior art polishing equipment have generally proved to be unsatisfactory at removing polishing defects. Accordingly, another advantage of the present invention is that the effectiveness of the buffing process is greatly improved by initiating the buffing process at the earliest opportunity after polish. As a result, the need for an HF acid process in the cleaning step for removing surface defects is substantially reduced or eliminated. Consequently, tool complexity is reduced and operator safety is greatly improved.

The following example illustrates the effectiveness of the dual purpose handoff station at removing particles from the surface of a semiconductor wafer. An experiment was performed wherein a 200 mm diameter unpatterned semiconductor wafer was cleaned by a conventional scrubbing process, and then buffed by a process simulating the process of the present invention. Measurements were taken of the clean wafer before and after the buff process to determine the number of particles present on the surface of the wafer at both times. All particle measurements were performed with a Tencor brand particle counting machine, model no. xxxxxxx.

The buffing process was performed on a Model no. SS-136 silicon wafer polishing machine, manufactured and sold by SpeedFam Ltd. of Japan. The SS-136 machine was operated in a such a way as to simulate the buffing process of the present invention by causing the wafer carrier to simultaneously rotate and oscillate while pressing the wafer against a fixed buffing pad. The process parameters for the experimental buffing process were as follows:

| | |
|---|---|
| Carrier rotational velocity: | 60 rpm |
| Carrier down force: | 30 pounds |
| Oscillation radius: | 1 inch |

-continued

| | |
|---|---|
| Oscillation pattern: | eliptical |
| Buffing time: | 30 seconds |
| Buffing fluid: | deionized water |

The wafer was pre-measured using the Tencor machine taking care to minimize handling of the wafer and maintain the cleaned condition, and post-measured after the above-described buffing process. A comparison of the pre and post measurements showed that after the buffing process there were on average 94 less particles (negative adders) of size greater than 0.2×10−6 m. present on the wafer than were detected by the pre-measurement. Particle count reductions of approximately 50 to 100 less particles are achievable by buffing similarly cleaned wafers using conventional second table buffing processes. Thus, the above described experiment demonstrates that the buffing process of the present invention provides buffing performance at least equivalent to that of conventional buffing processes.

Various modifications and alterations of the above described dual purpose load cup in addition to those already described will be apparent to those skilled in the art. For example, although the invention has been described generally in terms of processing semiconductor wafers, it is to be appreciated that the invention may be utilized with equal benefit for processing other workpieces, such as for example magnetic disks. Accordingly, the foregoing detailed description of the preferred embodiment of the invention should be considered exemplary in nature and not as limiting to the scope and spirit of the invention as set forth in the following claims.

What is claimed is:

1. A method of processing a surface of a workpiece in a workpiece processing apparatus, comprising the steps of:

causing a workpiece carrier holding a workpiece to bring said workpiece into pressing engagement with a first processing surface of a first workpiece processing station;

providing relative motion between said workpiece carrier and said first processing surface;

moving said workpiece carrier and said workpiece held thereto, to a workpiece handoff station having a second processing surface;

causing said workpiece carrier to bring said workpiece into pressing engagement with said second processing surface and drawing air down through a plurality of apertures defined in said second processing surface for vacuum-holding said workpiece theron, while providing relative motion between said workpiece carrier and said second processing surface; and transferring said workpiece from said handoff station to a second workpiece processing station.

2. A method of processing a surface of a workpiece in a workpiece processing apparatus, comprising the steps of:

causing a workpiece carrier holding a workpiece to bring said workpiece into pressing engagement with a first processing surface of a first workpiece processing station;

providing relative motion between said workpiece carrier and said first processing surface;

moving said workpiece carrier and said workpiece held thereto, to a workpiece handoff station having a second processing surface;

causing said workpiece carrier to bring said workpiece into pressing engagement with said second processing surface, while providing relative motion between said workpiece carrier and said second processing surface;

delivering a fluid to said second processing surface by flowing said fluid through a plurality of apertures in said second processing surface; and transferring said workpiece from said handoff station to a second workpiece processing station.

3. The method of claim 2, further comprising the step of selectively connecting said fluid apertures through a fluid manifold to one of a plurality of fluid sources.

4. A method of processing a surface of a workpiece in a workpiece processing apparatus, comprising the steps of:

causing a workpiece carrier holding a workpiece to bring said workpiece into pressing engagement with a first processing surface of a first workpiece processing station;

providing relative motion between said workpiece carrier and said first processing surface;

moving said workpiece carrier and said workpiece held thereto, to a workpiece handoff station having a second processing surface;

causing said workpiece carrier to bring said workpiece into pressing engagement with said second processing surface, while providing relative motion between said workpiece carrier and said second processing surface; and transferring said workpiece from said handoff station to a second workpiece processing station by activating a workpiece handling robot to retrieve said workpiece from said handoff station and deposit said workpiece at said second processing station.

5. The method of claim 4, wherein said transferring step further comprises moving said robot on a track.

* * * * *